United States Patent [19]

Trebilcock et al.

[11] 3,999,676

[45] Dec. 28, 1976

[54] COLLAPSIBLE CONTAINER

[75] Inventors: Lionel F. Trebilcock; Gary L. Trebilcock, both of Girard; Michael C. Marsh, Niles, all of Ohio

[73] Assignee: Litco Plastics Co., Vienna, Ohio

[22] Filed: Feb. 28, 1975

[21] Appl. No.: 553,967

[52] U.S. Cl. ..... 220/6; 220/1.5; 220/4 F; 206/512

[51] Int. Cl.[2] ..... B65D 7/24; B65D 7/00; B65J 1/02; B65D 7/28; B65D 21/00

[58] Field of Search ..... 220/4 R, 4 F, 6, 7, 220/1.5, 76, 80; 206/512; 217/15, 16, 47, 48

[56] References Cited

UNITED STATES PATENTS

| | | | |
|---|---|---|---|
| 2,486,532 | 11/1949 | Kubach | 220/6 X |
| 3,040,925 | 6/1962 | Mills | 220/4 F X |
| 3,497,127 | 2/1970 | Box | 220/6 X |
| 3,529,741 | 9/1970 | Walker et al. | 220/1.5 X |

*Primary Examiner*—William Price
*Assistant Examiner*—Steven M. Pollard
*Attorney, Agent, or Firm*—Gardiner, Sixbey, Bradford & Carlson

[57] ABSTRACT

A collapsible container having sidewalls pivotally mounted on the bottom wall so that all the sidewalls may be folded inwardly on the bottom wall for transportation or storage. Several of the sidewalls are adapted to pivot outwardly to facilitate the unloading of the container. The bottom of the container is provided with legs so that the container may be handled with a conventional fork lift.

16 Claims, 14 Drawing Figures

Fig. 11
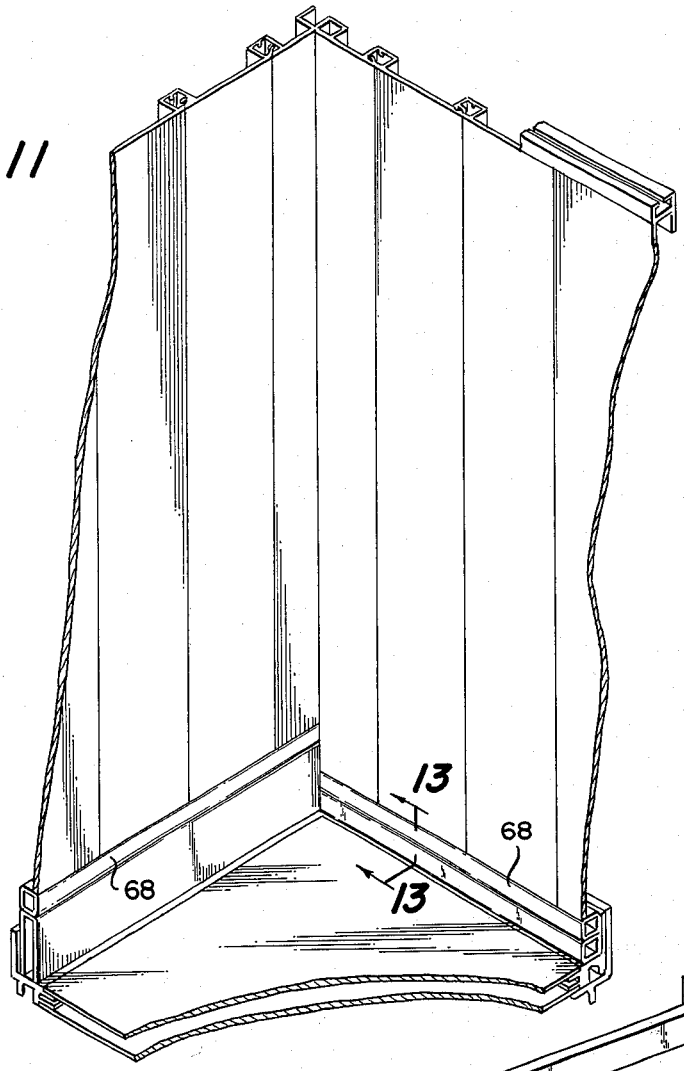
Fig. 12
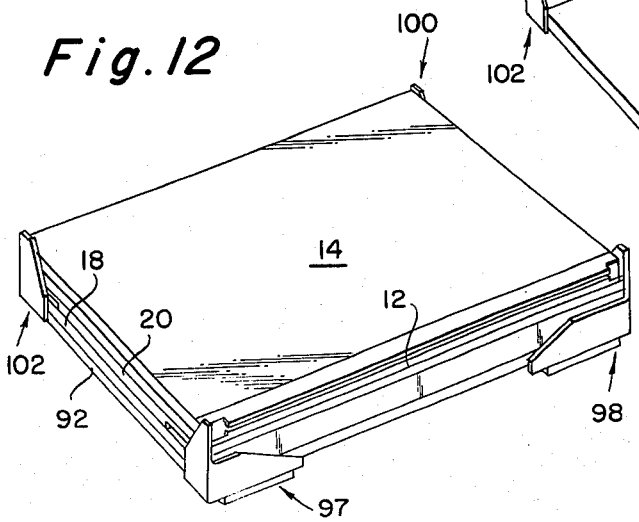
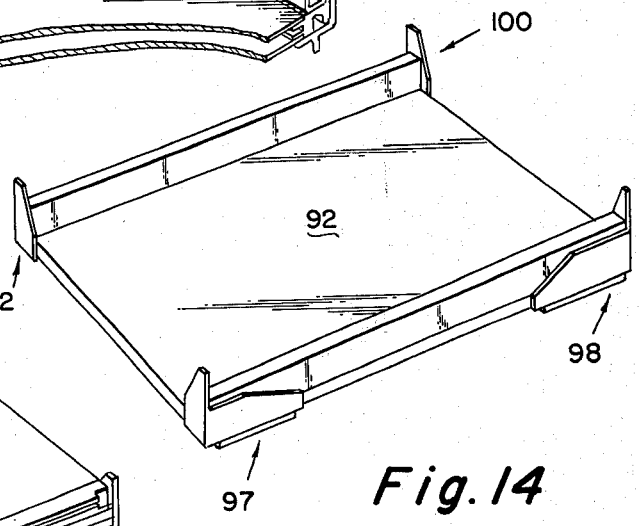
Fig. 14

COLLAPSIBLE CONTAINER

This invention relates to collapsible containers which may be easily and quickly assembled to receive a load; and conversely, disassembled into collapsed condition for storage and/or transportation.

There are many different types of collapsible containers presently used in commerce. Construction of the containers varies widely depending upon the use intended for the container. In some instances the walls are slidably engaged in assembled form. When the container is disassembled, the walls are separated from each other and must be handled separately.

Another form of construction is to pivotally mount the sidewalls on the bottom wall so the walls may be folded inwardly to a collapsed condition. The present invention relates to this type of construction. Broadly, this concept is not new and many patents have been issued relating to this type of collapsible container.

The strive by industry to produce a container having folding walls which may be constructed inexpensively and which will be durable has been a continuing effort as is evidenced by the patent art. Disposable containers are not longer as desirable as they once were because of the increasing problem of disposing of trash. Also, most disposable containers do not have the strength required for many uses in industry.

A collapsible container having folding walls presents many problems due to the inherent nature of its construction. Suitable hinge means must be provided that will endure long use. Additionally, the hinge means should be constructed so that it may be easily replaced if it becomes broken. One broken hinge renders the entire container useless as a collapsible container. Desirably, the hinge means should be protected from damage by contact with the contents in the container.

Latch means must be provided on each wall to maintain the walls in upright position. The latch must also be durable and strong. Desirably, the latch should be easily manipulated from one position to another without the use of a special tool or tools. The latch should be secured to the container so that it may be easily replaced if it is damaged.

In the instant invention, the container is formed of metal but other moldable materials may be used if desired. In order to produce a collapsible container of metal, cost of fabrication becomes a big factor in the design of the container and its parts.

The present invention provides a collapsible container having pivotally mounted walls which overcomes many of the disadvantages of known container construction and provides the beneficial features mentioned above. The container is constructed so that several of the walls may be pivoted outwardly of the container to facilitate loading or unloading the contents of the container.

The container of this invention is provided with legs so that the times of a fork lift truck may be inserted beneath the container for handling. A further feature of the container structure of this invention is the provision of means which enables the container to be stacked when in assembled condition as well as collapsed condition. This means will cooperate with the adjacent container to maintain a plurality of containers in stable stacked relation.

The sidewalls of the container of this invention are formed of panels of extruded lengths of metal formed with interlocking means along both sides. Three different types of extrusion are utilized. In this manner the panels are cut to desired length, snapped together and secured to a bottom member containing the hinge means. This construction results in a low cost of materials as well as low cost of assembling the sidewall.

Of the patents relating to the collapsible containers of this general type, U.S. Pat. No. 3,628,683 to Friedrich and U.S. Pat. No. 3,782,579 to Zarges are considered the most pertinent. The structure of the present container is quite different.

These and other advantages of the invention will become readily apparent from the following description and the accompanying drawings in which:

FIG. 11 is a fragmentary perspective view showing an end wall and a side wall in assembled position;

FIG. 12 is a diagrammatic view showing the carton in collapsed condition;

FIG. 14 is a perspective view of the bottom assembly of the container according to the invention.

The container 10 of this invention comprises a pair of sidewalls 12 and 14 pivotally mounted on a bottom wall 16. A pair of end walls 18 and 20 are also pivotally mounted on the bottom wall 16.

Figure 4:
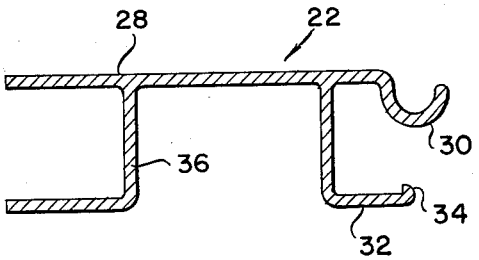
FIG. 4 is a cross sectional view of one of the wall panels.

Each all is formed of a plurality of extrusion in an identical manner so that a specific description of one wall will suffice. Referring to the side wall 12, three different extruded panels 22, 24 and 26 are joined together to form the sidewall. The edge panel 22 is extruded with a cross-sectional configuration illustrated in FIG. 4. The panel 22 is formed with a web portion 28 having an arcuate lip 30 extending along its one longitudinal edge. An L-shaped portion 32 extends along the same edge spaced from the arcuate lip 30 and is provided with a hook portion 34. A further L-shaped portion 36 extends along the opposite edge of the panel 22.

Figure 5:
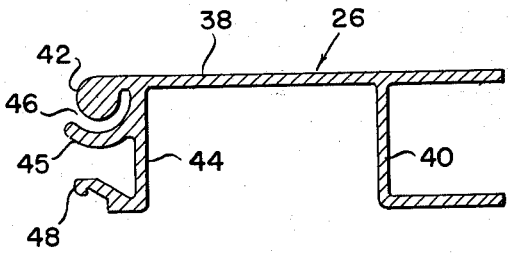
FIG. 5 is a cross sectional view of another wall panel.

The panel 26 of the sidewall 12 is extruded with a cross-sectional configuration illustrated in FIG. 5. The panel 26 is formed with a web portion 38 having an L-shaped portion 40 extending along the one edge of the web 38 the same as the L-shaped portion 36 of the panel 22. The other edge of the web 38 is formed with an enlarged rounded portion 42 and an L-shaped portion 44 adjacent thereto. An arcuate portion 45 extends from the base of the L-shaped portion 44 and, with the rounded portion 42, defines an arcuate groove 46. The outer end of the L-shaped portion 44 is provided with a hook means 48.

Figure 6:
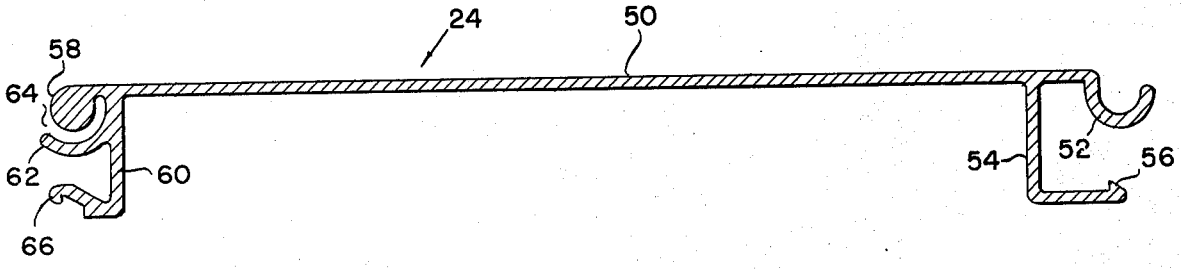
FIG. 6 is a cross sectional view of still another wall panel.
Figure 3:
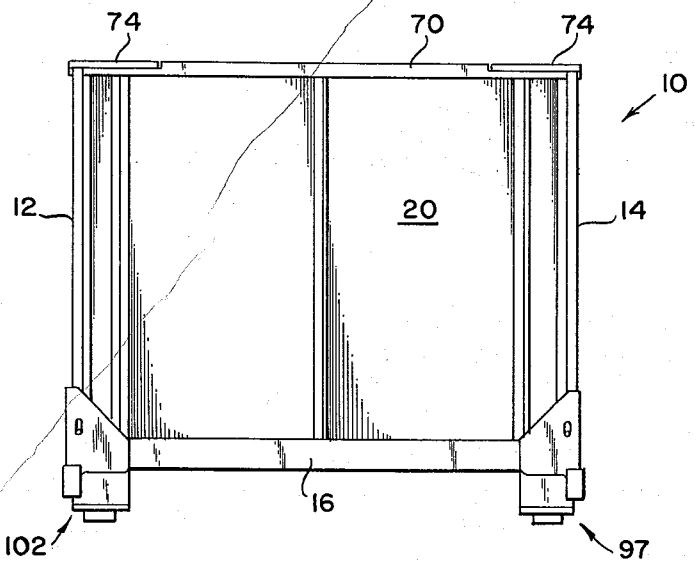
FIG. 3 is an end view of the container.

The intermediate panels 24 are extruded with a cross-sectional configuration as illustrated in FIG. 6. The panel 24 is formed with a web 50 having an arcuate lip 52 extending along its one longitudinal edge. An L-shaped portion 54 extends along the same edge spaced from the arcuate lip 52 and is provided with a hook portion 56. The portions 52, 54 and 56 are identical to the portions 30, 32 and 34 on panel 22. The other edge of the web 50 is formed with an enlarged rounded portion 58 and an L-shaped portion 60 adjacent thereto. An arcuate portion 62 extends from the base of the L-shaped portion 60 and, with the rounded portion 58 defines an arcuate groove 64. The outer end of the L-shaped portion 60 is provided with hook means 66. The portions 58, 60, 62 and 66 are identical to the portions 42, 44, 45 and 58 on the panel 26.

Figure 7:
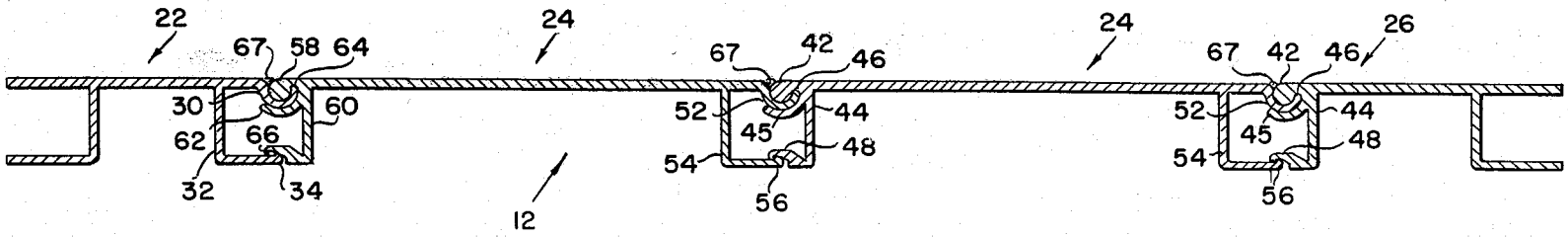
FIG. 7 is a sectional view taken on lines 7—7 of FIG. 2 showing the interlocking relationship of the wall panels.

The interlocking relationship of the panels will now be apparent as best shown in FIG. 7. Depending on the desired size container, several of the panels 24 are snapped together with the protions 52, 54 and 56 on one panel 24 engaging and mating with portions 58, 60, 62 and 66 on the adjacent panel. The panel 22 is snapped onto one of the panels 24 with the portions 30, 32, and 34 engaging and mating with the portions 58, 60, 62 and 66 on the panel 24. The arcuate lip 30 fits in the arcuate groove 64.

The panel 26 is engaged with a panel 24. The portions 42, 44, 45 and 48 engage and mate with the portions 52, 54 and 56 on the panel 24 with the arcuate lip 52 engaged in the arcuate groove 46. The panels may now be secured together by assembled sidewall 12 is then secured to an elongated hollow member 68 which is substantially square in cross-section.

Figure 10:
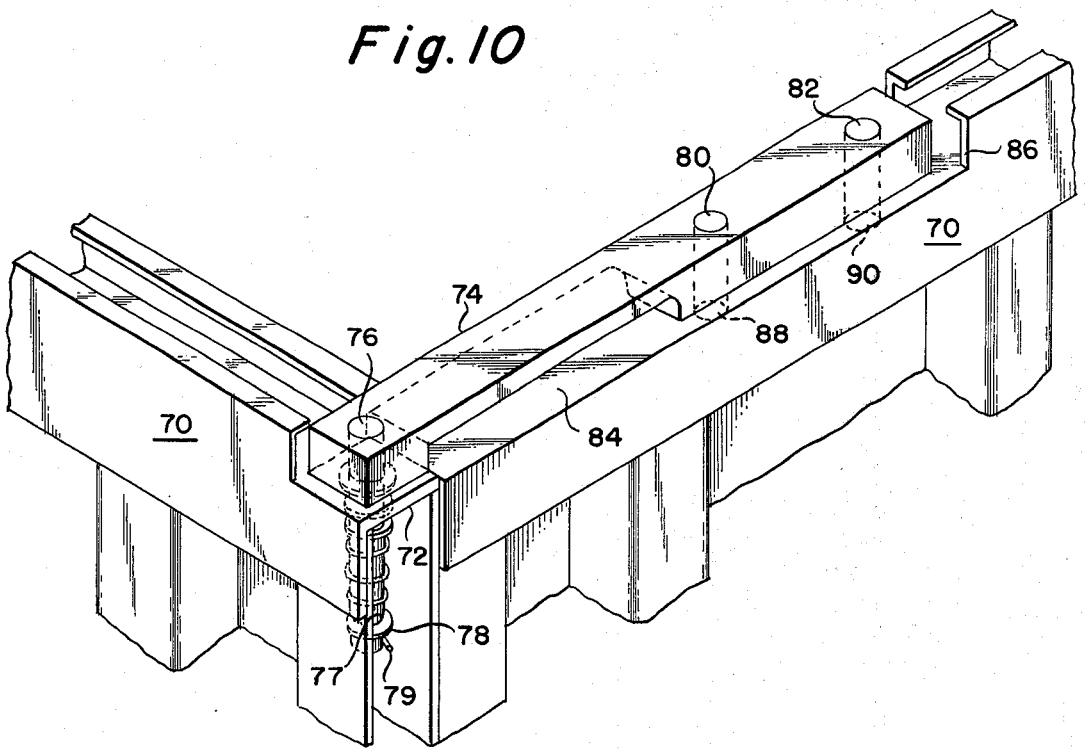
FIG. 10 is a fragmentary perspective view showing the latch means.

A top frame member 70 is comprised of an extrusion having an cross-sectional shape substantially in an H form as shown in FIG. 10 which telescopically receives the upper edge of the sidewall. The frame member 70 is notched at one end and is provided with a bearing block 72 secured thereto. A latch bar 74 is pivotally mounted on the bearing block 72 by a hinge pin 76 journaled in the bearing block. The hinge pin 76 is slidable in the bearing block and is urged downwardly by a coil spring 77 held in place by a washer 78 and cotter pin 79. The latch bar 74 is provided with a pair of locking pins 80 and 82 adjacent its free end and a cut-out portion 84. The cut-out portion 84 forms a space between the latch bar and the adjacent wall so that a person may insert his fingers and grip the latch bar to raise and to pivot it, as will become more readily apparent below.

The other end of the frame member 70 is also notched as indicated by 86 thus exposing the horizontal web of the H beam which is provided with a pair of apertures 88 and 90 adapted to receive the locking pins 80 and 82.

Figure 13:
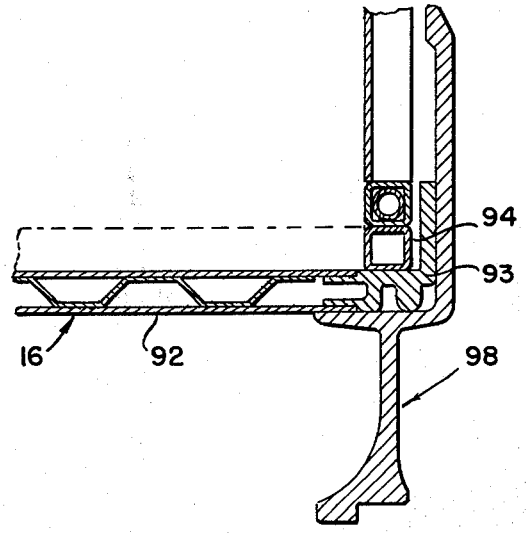
FIG. 13 is a section taken on lines 13—13 of FIG. 11 showing the end wall pivot arrangement.

The bottom wall 16 comprises a conventional sandwich type metal panel 92 framed by L-shaped extrusions 93. Spacers are provided adjacent two opposite edges of the bottom panel to accommodate inward folding of the sidewalls as best illustrated in FIG. 13. The spacers are rigidly secured to the bottom wall by welding. No spacers are secured to the bottom wall adjacent the remaining edges. Spacers 94 and 96 comprised of a hollow extrusion retangular in cross section and of a dimension equal to twice the thickness of one wall are secured along opposite edges of the bottom wall panel 92.

Figure 1:
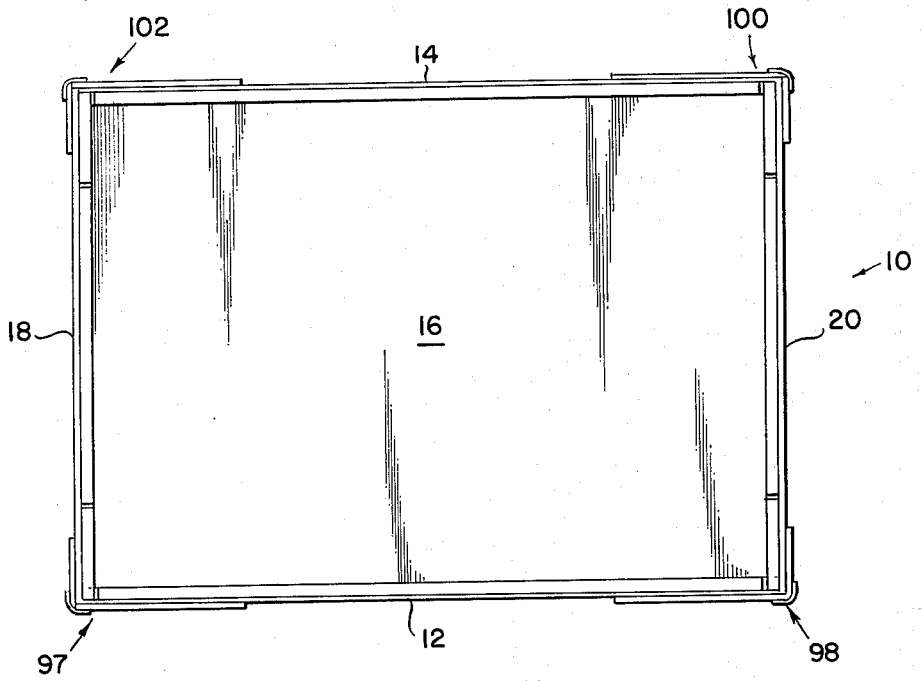
FIG. 1 is a plan view of the container of the invention.

Foot members 97, 98, 100 and 102 are secured to each corner of the bottom wall 16 in any suitable manner, perferably by welding. The foot members are identical in construction except that 98 and 102 are mirror images of 97 and 100, so a detailed description of one of the members will suffice. The foot member 97 is formed in an L-shape as viewed from the top of FIG. 1. The long leg 104 has a horizontally extending ledge 106 which is adapted to be secured to the bottom surface of the bottom wall 16. The leg 104 has an upright wall 108 and a vertically depending flange 110 which is displaced inwardly of the wall 108. The wall 108 is provided with an elongated slot 112, the purpose of which will be described below.

The short leg 114 also has a horizontally extending ledge 116 which is adapted to be secured to the bottom surface of the bottom wall 16. The leg 114 has an upright wall 118 and a vertically depending flange 120 which is displaced inwardly of the wall 118. The wall 118 is provided with an elongated shot 122, the purpose of which will be described below. The bottom of each foot is provided with a projecting skid surface 125. An arcuate guard member 124 may be provided if desired. The foot member 97, in the preferred embodiment, is formed as in integral unit by casting. Since the foot members 97, 98, 100 and 102 are identical, it is readily apparent that the cost of producing the members is greatly reduced as compared to custom fabrication of each foot member.

Figure 9:
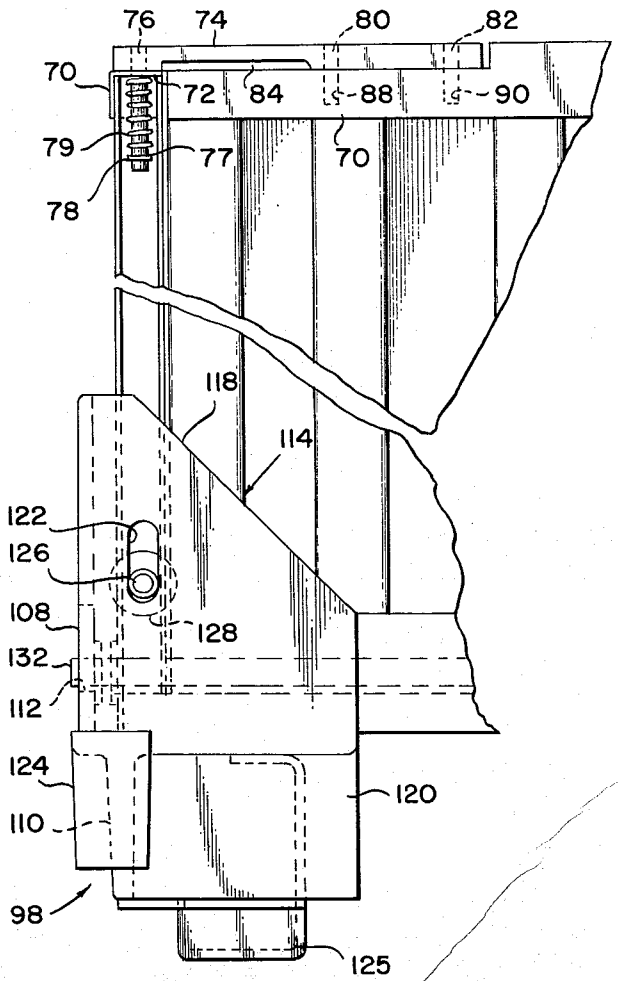
FIG. 9 is a fragmentary ene elevational view of FIG. 8.
Figure 8:
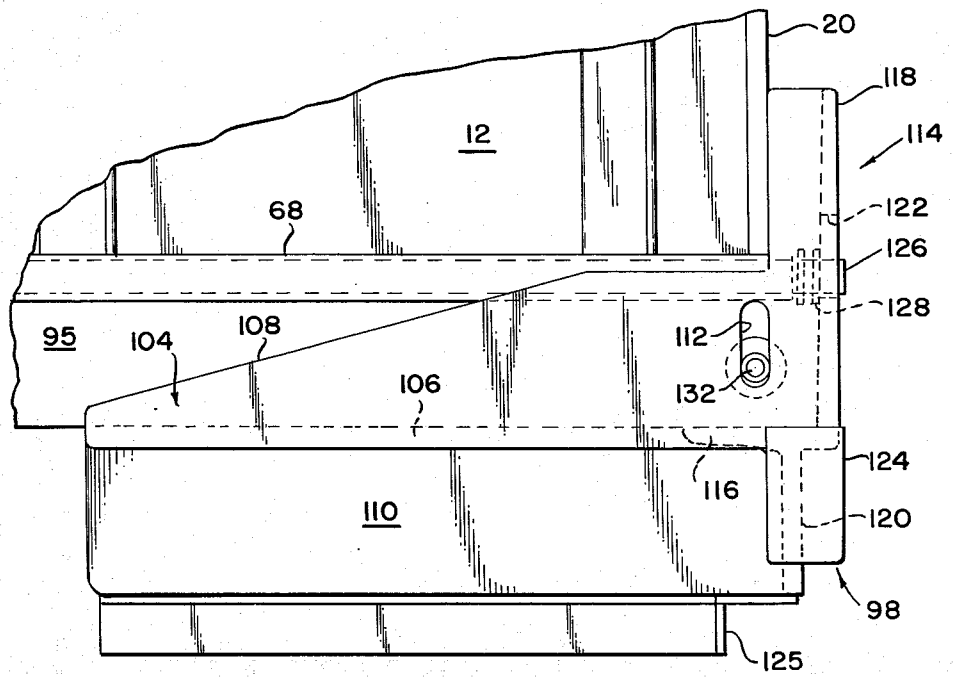
FIG. 8 is a fragmentary side elevational view of a corner showing the hinge means.

The assembly of the container will now be described. The walls are pivotally secured to the foot members by hinge means and rest on the bottom wall panel 92 and the spacers 94, and 96 in identical fashion, so that a description of one hinge assembly will be sufficient. Referring to FIGS. 8 and 9, a hinge pin 126 is inserted through the slots 122 in the foot members 97 and 98 and the hollow member 68 of the side wall 12. The hinge pin 126 is maintained in place by washers 128 and cotter pins not shown at each end thereof. The sidewall 12 is supported on the spacer 94.

The end wall 20 is pivotally mounted on a hinge pin 132 extending through the hollow member 68 and slots 112 in foot member 98 and 100 and secured by washers and cotter pins at each end thereof in the same manner as hinge pin 126. The end wall 20 is supported on the bottom wall with no spacer therebetween.

The other sidewall is supported on the top of the spacer 96 in the same manner as sidewall 12. The other end wall 18 is secured on top of the bottom wall 92 in the same manner as the end wall 20.

The container is now completely assembled and the operation of the container will be described. The end wall 20 is the first to be folded inwardly to a position overlying the bottom panel 92. Next the end wall 18 is folded inwardly over the end wall 20. The elongated slots in the foot members permit vertical movement of the hinge pin and wall so the wall will lie flat on the underlying wall. The sidewall 12 resting on the spacer 94 is then folded inwardly on top of the end wall 18 and thereafter the sidewall 14 is folded on top of the sidewall 12.

Due to the spacing of the walls at a different height, they may be folded flat. The elongated slots in the foot members permit vertical movement of the walls during pivotal movement which is necessary due to the square housing of the hinge pins. The elongated slots also permit only one design for each foot member even though the walls are journaled at different heights relative to the bottom.

To assemble the container in its upright position, the above described manipulation of the walls is reversed. With the walls in upright position, the latch bar 74 is raised from its position shown in phantom lines in FIG. 10. This is accomplished by grasping the latch bar 74 with fingers inserted into the cutout area 84 and lifting vertically. With the latch bar 74 raised sufficiently so that the locking pins 80 and 82 will clear the edges of the channel in the member 70, the latch bar is pivoted to the position shown in said lines in FIG. 10. The locking pins enter the aperture 88 and 90 to secure the two walls together. This procedure is repeated for each latch bar until all four walls are secured together. The container is now ready for use.

Figure 2:
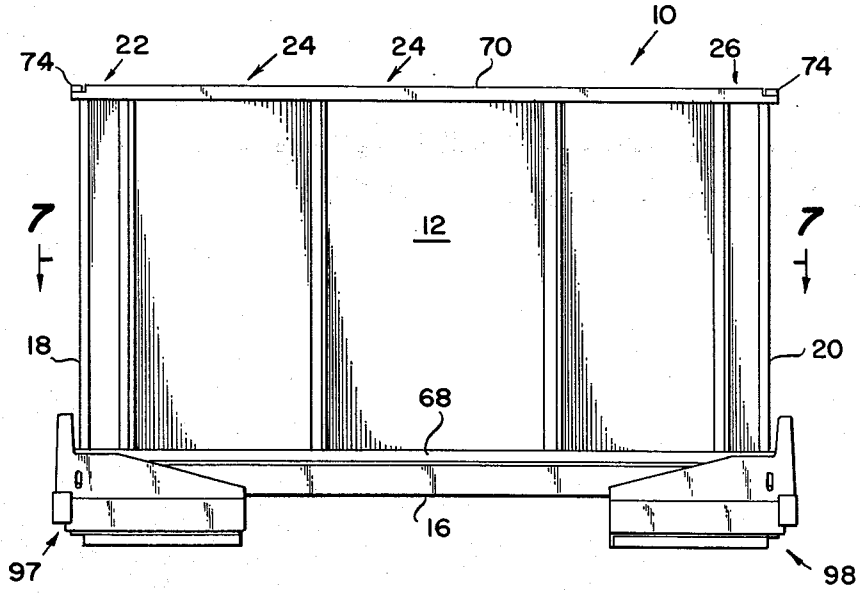
FIG. 2 is a front view of the container.

As best illustrated in FIGS. 2 and 8, the upstanding wall 108 of the foot members 97 and 98 extends along slightly above the bottom of the sidewall 12. This arrangement permits the sidewall 12 to be pivoted outwardly from the bottom as well as inwardly. This is also true of the opposite sidewall 14. The purpose of this is to permit easy access to the container for loading or unloading.

From the foregoing description, many advantages of the present container construction are readily apparent. The hinge means of the walls are readily removed and replaced. In order to remove a hinge pin such as 126, it is necessary only to remove the cotter pins 130 at each end thereof and slide the pin 126 out of the member 68 and replace it with a new pin.

The latch bars 74 are also readily accessible for removal if necessary. The cotter pin 79 is removed from the pin 76 together with the washer 78 which releases the coil spring 77 and the latch bar may be removed easily for repair or replacement.

The walls of the container are formed entirely of extruded members. Because of this, the various members may be purchased in convenient standard lengths from the producer. The container manufacturer can cut the extrusions to desired lengths depending on the size of container to be manufactured. The size of the container may be varied without the need of a large stock of various sizes of parts since all parts are standard as received from the metal extrusion producer.

The walls of the container are comprised of three different extrusion members. The width of the walls may be varied by the number of the panels 24 included in each wall. The height of the container may be varied merely by cutting the extrusion panels to the proper length. The top frame member 70 is cut to desired length by the container manufacturer.

The bottom member 60 is also an extrusion which may be purchased in convenient lengths and custom cut to fit the wall. The bottom wall 16 is also cut to size by the container manufacturer as well as the framing members 93.

The foot members are all identical so a large stock of these is not necessary.

In this manner, containers of desired sizes may be assembled without the need of a large quantity of parts. Since all of the parts are formed of extrusions of light weight metal, the formed container is very sturdy and capable of transporting heavy loads.

The hinge means is enclosed in the hollow member 68 and thereby prevented from damage by the load in the container.

The containers are formed in a manner that they may be stacked in interlocking relation both in upright condition and in collapsed condition. In the upright position, the skid surface 125 depend into the interior of the container on which is rests to prevent relative lateral movement of the containers. In the collapsed condition, the upright wall on one container will overlap the depending flange 110 on the container above the prevent relative lateral movement.

The space underneath the bottom wall between the foot members enables the engagement thereof by a conventional fork lift truck for easy handling.

We claim:

1. A collapsible container comprising a bottom member, a pair of end walls pivotally secured thereto for folding inwardly over the bottom member, a pair of side walls pivotally connected to said bottom member for folding inwardly over the bottom member and also for folding outwardly of the bottom member, each wall having latch means adjacent one top corner and latch receiving means adjacent the opposite top corner, each wall being formed of extruded panels, and each panel having along at least one edge thereof interlocking means adapted to cooperate with the interlocking means of the adjacent panel.

2. A collapsible container as set forth in claim 1 wherein spacer means are provided adjacent three edges of said bottom member to support one end wall and the two sidewalls at varying heights above said bottom member so that said walls may be folded inwardly in overlying flat relation.

3. A collapsible container as set forth in claim 2 wherein said walls are journaled in vertically extending slots in said bottom member.

4. A collapsible container as set forth in claim 1 wherein said latch means comprises a bar pivotally mounted on said wall and adapted to be slidably moved vertically from the top of said wall.

5. A collapsible container as set forth in claim 4 including spring means resisting slidable movement of said latch bar.

6. A collapsible container as set forth in claim 5 including locking pins on said latch bar adapted to engage apertures in the adjacent wall.

7. A collapsible container as set forth in claim 1 wherein each of said walls is pivotally connected to said bottom member by a single pin which is readily removable from said wall.

8. A collapsible container as set forth in claim 1 including means to assist stacking of the container on top of another container.

9. A collapsible container comprising a bottom member having foot members adjacent each corner thereof, first and second spacers, a pair of end walls and a pair of sidewalls, said first and second spacers connected to said bottom member adjacent opposite edges thereof, one of said end walls being pivotally mounted on said bottom member adjacent an edge without a spacer, the other of said end walls being pivotally mounted on said bottom member adjacent the opposite edge without a spacer, and said sidewalls being pivotally mounted on said bottom member and being supported on said first and second spacers, said end walls and said sidewals being pivotally journalled in said foot members and moveable relative to said bottom members and said spacers, and vertically extending slots in said foot members.

10. A container as set forth in claim 9 wherein said sidewalls and endwalls are provided with hinge pins extending along their bottom edges, and said hinge pins being journaled in said elongated slots.

11. A container as set forth in claim 10 wherein said hinge pins are removably mounted in said elongated slots.

12. A container as set forth in claim 10 wherein said hinge pins are housed within the tubular members secured along the bottom edges of said sidewalls and endwalls.

13. A container as set forth in claim 10 wherein said endwalls and said sidewalls are adapted to pivot inwardly on top of each other in collapsed condition.

14. A container as set forth in claim 10 wherein said sidewalls are adapted to pivot both inwardly and outwardly of said bottom member.

15. A container as set forth in claim 9 including latch means on each of said endwalls and said sidewalls.

16. A container as set forth in claim 15 wherein each of said endwalls and said sidewalls is provided with means to receive said latch means.

* * * * *